US006203150B1

(12) United States Patent
Zaba et al.

(10) Patent No.: US 6,203,150 B1
(45) Date of Patent: Mar. 20, 2001

(54) LIQUID COLLECTION

(75) Inventors: Jerzy Marcin Zaba; William Anthony Denne; Richard Frank Mitchell, all of Cambridge (GB)

(73) Assignee: Domino Printing Sciences Plc (GB)

( * ) Notice: Subject to any disclaimer, the term of this patent is extended or adjusted under 35 U.S.C. 154(b) by 0 days.

(21) Appl. No.: 09/284,342

(22) PCT Filed: Oct. 8, 1997

(86) PCT No.: PCT/GB97/02767

§ 371 Date: Apr. 8, 1999

§ 102(e) Date: Apr. 8, 1999

(87) PCT Pub. No.: WO98/16390

PCT Pub. Date: Apr. 23, 1998

(30) Foreign Application Priority Data

Oct. 16, 1996 (GB) ..... 9621525

(51) Int. Cl.[7] ..... B41J 2/185
(52) U.S. Cl. ..... 347/90
(58) Field of Search ..... 347/89, 90, 92, 347/93, 30, 36

(56) References Cited

U.S. PATENT DOCUMENTS 4,023,182 * 5/1977 Arway et al. ..... 347/90
4,418,352 * 11/1983 Horike et al. ..... 347/80
4,476,472 * 10/1984 Aiba et al. ..... 347/86
4,586,058 * 4/1986 Yamazaki et al. ..... 347/92
5,614,929 * 3/1997 Dangelo et al. ..... 347/30

FOREIGN PATENT DOCUMENTS 597 674 * 5/1994 (EP) .
62-113559 * 5/1987 (JP) .
98/16390 * 4/1998 (WO) .

* cited by examiner

*Primary Examiner*—N. Le
*Assistant Examiner*—Michael Nghiem
(74) *Attorney, Agent, or Firm*—Robert F. I. Conte; Lee, Mann, Smith, McWilliams, Sweeney & Ohlson

(57) ABSTRACT

A liquid collection apparatus comprises a liquid collecting device and liquid conduit for transferring liquid from the liquid collection device. Porous liquid absorption device is positioned between the liquid collection device and the liquid conduit. Pump device pumps liquid from the liquid conduit, the pump device generating a pressure in the conduit that is sufficient to draw liquid through the liquid collection device but is insufficient to draw a gas/liquid surface through the liquid absorption device.

9 Claims, 2 Drawing Sheets

Fig. A
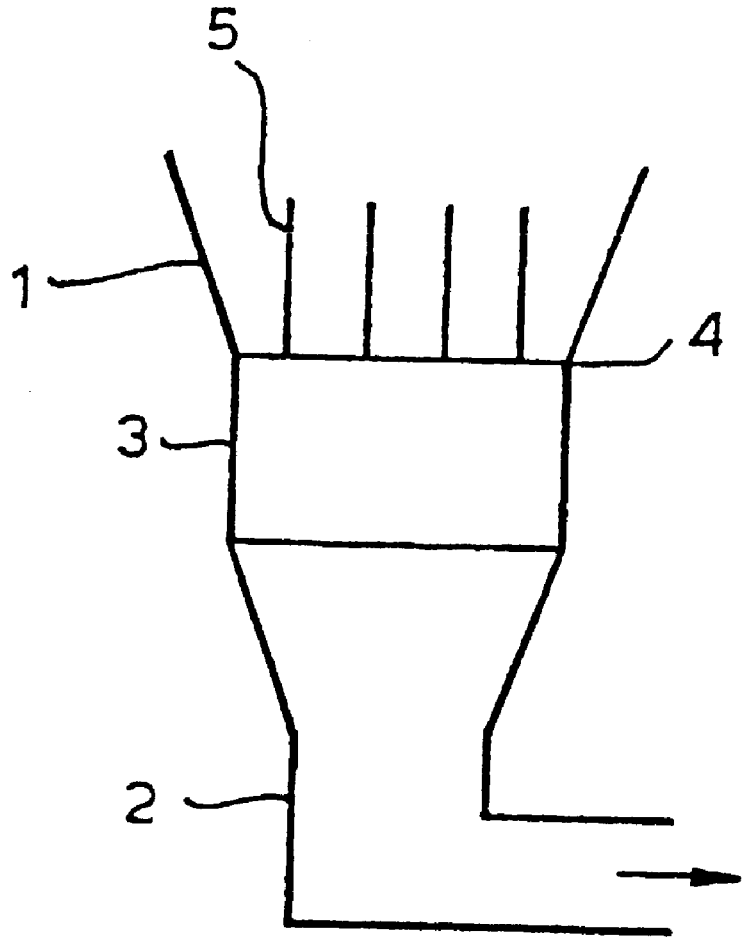

Fig. B
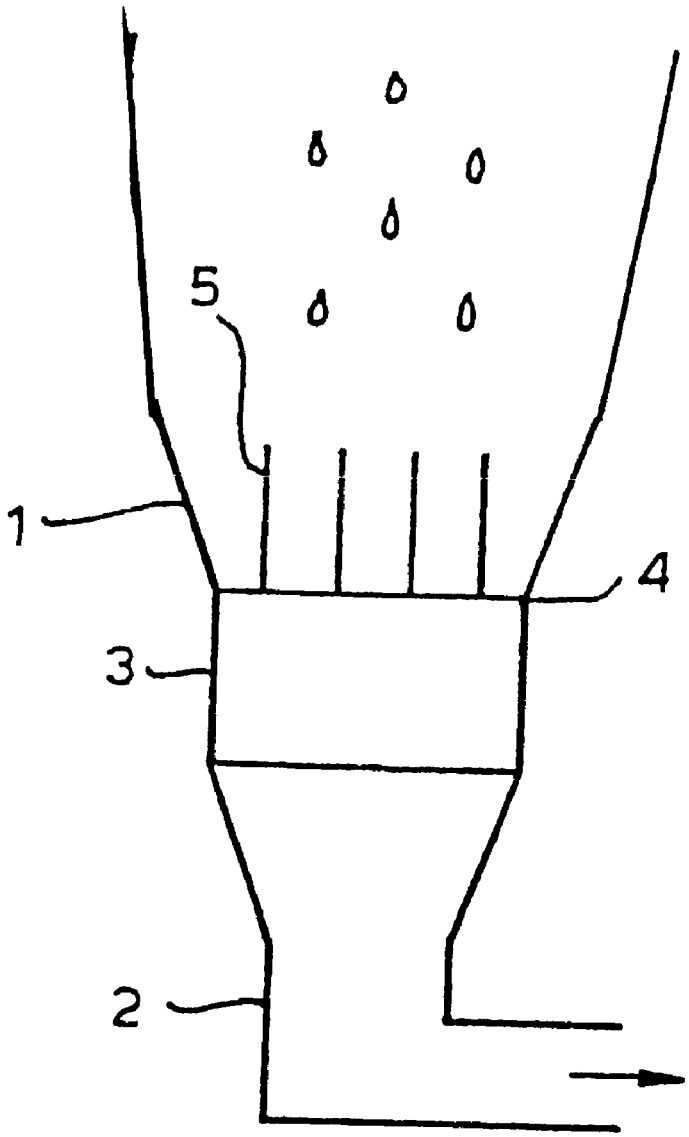

LIQUID COLLECTION

This invention relates to apparatus and method for collecting liquids and, in particular, to liquid collection apparatus and methods of the type employed in printing devices to collect unused ink.

Traditional liquid collection devices collect liquid (in the case of printing, ink) for reuse in the process in which the liquid is being employed. Such liquid collection devices do, however, have problems associated with them.

One significant problem is that air can be collected with the liquid and mixed with it by the collection device. The air can contain contaminants, which are drawn into the liquid, reducing the quality of the recycled liquid. A further problem, particular to printing inks, is that mixing of the inks with air can lead to ink solvent evaporation into the air, increasing the viscosity of the ink.

The present invention is directed towards the provision of a liquid collection apparatus which collects liquid without collecting air trapped therein.

According to the present invention there is provided a liquid collection apparatus comprising:

means for collecting liquid;

liquid conduit means for transferring liquid from the liquid collection means;

porous liquid absorption means positioned between the liquid collection means and the liquid conduit; and pump means for pumping liquid from the liquid conduit, the pump means generating a pressure in liquid in the conduit that is sufficient to draw liquid through liquid collection means but is insufficient to draw a gas/liquid surface through the liquid absorption means.

Because the pressure generated by the pump means is not sufficient to draw a gas/liquid surface through the porous liquid absorption means against surface tension forces in the absorption means, any gas contained within the liquid will not be drawn through the liquid absorption means and into the liquid conduit.

The apparatus may be arranged to be employed in an ink jet printhead, in which case the liquid may be ink. The liquid absorption means may have pores of a diameter of one micron or less. The pore diameters may be in the range of 0.2 to 1 micron. Alternatively, it may be formed from a plurality of narrow capillaries.

The material from which the liquid absorption means is formed will be dependent upon the type of liquid being collected, but may formed from cellulose, nylon, mixed esters, or polypropylene.

The liquid collecting means may be arranged so that the surface of the liquid absorption means is not in direct contact with the atmosphere, to reduce the possibility of liquid retained by the absorption means drying due to contact with the atmosphere. The liquid collection means may be formed from a plurality of ribs or of an absorbent material containing pores/capillaries of larger diameter than those in the liquid absorption means. Such an arrangement provides an apparatus which can be moved without liquid spilling out due to the effects of the motion and/or gravity.

According to the present invention there is also provided a method of collecting liquid, the method comprising the steps of:

collecting liquid in a liquid collection means; and drawing the liquid through a porous liquid absorption means at a pressure level which ensures liquid flow through the liquid collection means yet which is insufficient to draw liquid through the liquid absorption means.

Referring to FIGS. A & B, a liquid collection apparatus according to the present invention has a liquid collection means 1 in the form of a gutter. A conduit 2 is connected to a pump (not shown). Positioned between the liquid collection means 1 and conduit 2 is a liquid absorption means 3. This liquid absorption means 3 has, in this example, a structure such that it has a plurality of pores of a diameter of 1 micron or less.

In operation, the pump is operated to draw liquid collected by the liquid collection means 1 through the liquid absorption means 3 and into the conduit 2. The strength of the pump is such that it creates a sufficient pressure differential across the liquid absorption means 3 to ensure liquid flow therethrough. The operation of the pump is controlled, however, such that it does not generate a sufficient pressure differential to draw the gas/liquid surface through the absorption means 3. This ensures that, if air or any gas is draw into the liquid collection means 1 it is not drawn into the absorption means 3 because the constant presence of liquid at the interface between the liquid and the gas at the boundary 4 between the collection means 1 and liquid absorption means 3 prevents the gas being drawn into the conduit 2.

As mentioned above, the material from which the porous liquid absorption means 3 is formed will be dependent upon the type of liquid being collected, and should be selected so that it does not react with the collection liquid.

As also mentioned above, the liquid collection means may include a plurality of ribs 5 to retain the liquid in use, and prevent spillage. Alternatively, it may be formed from absorbent material (not shown) of a density lower than that of the absorption means 3.

In this example, the arrangement shown is employed to collect ink from a continuous ink jet printhead. It will be appreciated, however, that the collection device of the invention has applications in many other fields.

What is claimed is:

1. A liquid collection apparatus comprising:

a liquid collecting means;

liquid conduit for transferring liquid from the liquid collection means;

porous liquid absorption means positioned between the liquid collection means and the liquid conduit; and pump means for pumping liquid from the liquid conduit, the pump means generating a pressure in the conduit that is sufficient to draw liquid through the liquid collection means but is insufficient to draw a gas/liquid surface through the liquid absorption means.

2. An apparatus according to claim 1, wherein the liquid absorption means has pores of a diameter of one micron or less.

3. An apparatus according to claim 2, wherein the pore diameters are in the range of 0.2 to 1 micron.

4. An apparatus according to claim 1, wherein the liquid absorption means is formed from a plurality of narrow capillaries.

5. An apparatus according to claim 1, wherein the material from which the liquid absorption means is formed is one of cellulose, nylon, mixed esters, or polypropylene.

6. An apparatus according to claim 1, wherein the liquid collection means is formed from a plurality of ribs.

7. An apparatus according to claim 1, wherein the liquid collection means is formed from an absorbent material containing pores/capillaries of larger diameter than those in the liquid absorption means.

8. An apparatus according to claim 1 arranged to be employed in an ink jet printhead.

9. A method of collecting liquid, the method comprising the steps of:

collecting liquid in a liquid collection means; and drawing the liquid through a porous liquid absorption means at a pressure level which ensures liquid flow through the liquid collection means yet which is insufficient to draw a gas/liquid surface through the liquid absorption means.

* * * * *